US007583918B2

(12) United States Patent
Samweber

(10) Patent No.: US 7,583,918 B2
(45) Date of Patent: Sep. 1, 2009

(54) ELECTROGRAPHIC PRINTING OR COPYING DEVICE, AND METHOD FOR OPERATING ONE SUCH PRINTING OR COPYING DEVICE

(75) Inventor: Joachim Samweber, Eichenau (DE)

(73) Assignee: Oce Printing Systems GmbH, Poing (DE)

( * ) Notice: Subject to any disclaimer, the term of this patent is extended or adjusted under 35 U.S.C. 154(b) by 331 days.

(21) Appl. No.: 11/718,463

(22) PCT Filed: Dec. 7, 2005

(86) PCT No.: PCT/EP2005/056562

§ 371 (c)(1),
(2), (4) Date: May 2, 2007

(87) PCT Pub. No.: WO2006/061401

PCT Pub. Date: Jun. 15, 2006

(65) Prior Publication Data

US 2008/0013990 A1 Jan. 17, 2008

(30) Foreign Application Priority Data

Dec. 9, 2004 (DE) ..... 10 2004 059 532

(51) Int. Cl.
*G03G 15/09* (2006.01)

(52) U.S. Cl. ..... 399/273

(58) Field of Classification Search ..... 399/267, 399/273, 274, 283
See application file for complete search history.

(56) References Cited

U.S. PATENT DOCUMENTS

| | | | | |
|---|---|---|---|---|
| 4,647,179 | A | 3/1987 | Schmidlin | |
| 4,752,810 | A | 6/1988 | Schmidlin et al. | |
| 4,786,936 | A | 11/1988 | Ikegawa et al. | |
| 5,579,092 | A | 11/1996 | Isobe et al. | |
| 5,869,214 | A | 2/1999 | Anzai et al. | |
| 6,317,576 | B1 * | 11/2001 | Ishida et al. | 399/273 |
| 6,785,498 | B2 * | 8/2004 | Manno | 399/267 |
| 2004/0105706 | A1 | 6/2004 | Selinger et al. | |
| 2005/0036806 | A1 | 2/2005 | Hollig et al. | |

FOREIGN PATENT DOCUMENTS

| | | |
|---|---|---|
| DE | 32 01 529 | 11/1982 |
| DE | 197 30 729 | 1/1998 |
| DE | 101 52 892 | 5/2003 |
| DE | 102 46 022 | 7/2004 |
| JP | 63 008681 | 1/1988 |
| JP | 06 314030 | 11/1994 |
| JP | 2003 280251 | 10/2003 |

OTHER PUBLICATIONS 2.2 Fotoleiter Das Druckerbush Technologie 3-11-3-16.
English Translation of 2.2 Fotoleiter Das Druckerbush Technologie pp. 3-11 to 3-16.

* cited by examiner

*Primary Examiner*—Hoang Ngo
(74) *Attorney, Agent, or Firm*—Schiff Hardin LLP

(57) ABSTRACT

In a method or device for operation of an electrographic printing or copying device, at least toner particles are accumulated on a surface of a first carrier element. After a transfer of toner particles onto a further carrier element, toner particles still remaining on the first carrier element are removed by generating a traveling field between the first carrier element and the cleaning device which transports the toner particles.

19 Claims, 6 Drawing Sheets

ELECTROGRAPHIC PRINTING OR COPYING DEVICE, AND METHOD FOR OPERATING ONE SUCH PRINTING OR COPYING DEVICE

BACKGROUND

The preferred embodiment concerns an electrographic printing or copying device and in particular the cleaning of an applicator element that feeds toner to a photoconductor element. The preferred embodiment also concerns a method for operation of such a cleaning device.

A known device for cleaning of carrier elements in printers or copiers (DE 101 52 892 A1) comprise applicator rollers, photoconductor drums, transfer belts or photoconductor belts that are cleaned with magnetic roller arrangements. The surfaces of the rollers, drums or belts should be cleaned of toner with these magnetic roller arrangements.

In the known device a toner mixture made up of carrier particles and toner particles is supplied to an applicator roller via a magnetic roller arrangement. The applicator roller then transfers the toner particles onto a photoconductor corresponding to the characters to be printed. The toner remaining on the applicator roller and not transferred onto the photoconductor is removed from the surface of the applicator roller with a second magnetic roller arrangement. For this what is known as a magnetic brush is generated by the second magnetic roller arrangement, which magnetic brush brushes the still-remaining toner from the surface of the applicator roller with the aid of magnetic carrier particles arranged like beads. The toner mixture is then directed away from the applicator roller via rotation of the outer magnetic roller and fed again to a reservoir for toner mixture.

A device for transport of toner is known from the U.S. Pat. No. 4,647,179. The toner should thereby be applied on a photoconductor element in a developer station. For this charged toner particles are transported from a reservoir vessel to a traveling field device. The traveling field device comprises a plurality of spaced, linear electrodes that are connected with an alternating voltage source. Phase offset voltages are applied to the successive electrodes such that a progressive alternating electrostatic field arises. Toner particles are moved along the progression direction to the photoconductor element via this alternating field and the toner particles are drawn onto the photoconductor element via the corresponding oppositely charged photoconductor element.

For cleaning of the photoconductor element a vacuum sucker is provided that sucks the toner particles from the photoconductor element. In the known devices the toner is significantly damaged upon cleaning of the applicator elements since it is severely mechanically stressed in the cleaning, either due to the suction or by the brushing.

In a further known electrographic printing or copying device (DE 197 30 729 A1), toner is removed from a photoconductor belt by means of a cleaning device. The toner is thereby electrically and mechanically removed by the cleaning device. The cleaning device is a roller that rotates. The cleaning device is additionally connected to a direct voltage source whose voltage is set between 200 and 1000 V dependent on the toner quantity on the photoconductor belt. The transport of the toner away thereby occurs via rotation of the cleaning device, whereby the transfer onto the roller is assisted by the voltage.

The cleaning device comprises a cylindrical fur brush that rotates counter to the rotation direction of the photoconductor drum and thereby mechanically removes the toner from the photoconductor drum. A cleaning blade supports the removal of the toner from the photoconductor drum. A beating rod removes the toner from the fur brush and allows it to fall into a toner discharge screw. From there the toner is mechanically transported away.

Here an electromechanical cleaning also occurs, which is disadvantageous due to the wear.

SUMMARY

It is an object to achieve an electrographic printing or copying device given which no mechanical load or only a slight mechanical load is present for the toner in the cleaning of a carrier element and which exhibits no mechanically moving parts.

In a method or device for operation of an electrographic printing or copying device, at least toner particles are accumulated on a surface of a first carrier element. After a transfer of toner particles onto a further carrier element, toner particles still remaining on the first carrier element are removed by generating a traveling field between the first carrier element and the cleaning device which transports the toner particles.

DESCRIPTION OF THE PREFERRED EMBODIMENT

Figure 1:
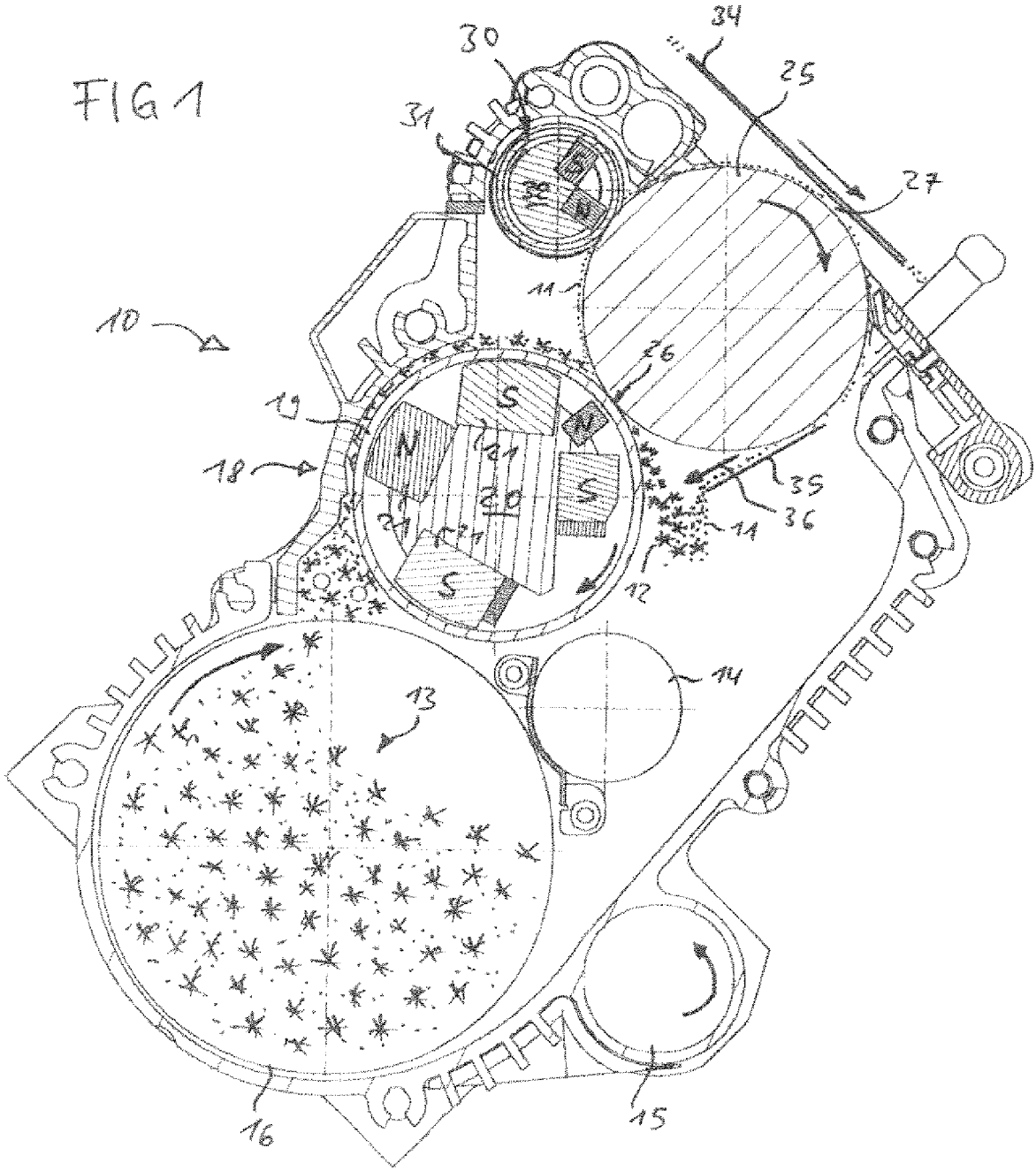
FIG. 1 is section through electrographic printing or copying device of the preferred embodiment.

For the purposes of promoting an understanding of the principles of the invention, reference will now be made to the preferred embodiment illustrated in the drawings and specific language will be used to describe the same. It will nevertheless be understood that no limitation of the scope of the invention is thereby intended, and such alterations and further modifications in the illustrated device and such further applications of the principles of the invention as illustrated as would normally occur to one skilled in the art to which the invention relates are included.

The printing or copying device in the preferred embodiment thereby comprises a cleaning element that is arranged at a distance from a carrier element to be cleaned. An electrical and/or magnetic field by which the toner particles are drawn to the cleaning device exists between the carrier element and the cleaning device. The cleaning element comprises a traveling field generation element via which the attracted toner particles are transported away along the traveling field.

Such a traveling field device has the advantage that the toner particles are transported away in the direction of the progressing traveling field without being mechanically stressed. The toner particles thereby do not abrade on the cleaning device but rather are moved by the field forces. The abrasion of the particles on one another is also relatively slight. Various transport directions can be realized via simple control. The traveling field can also be utilized to draw the toner particles from the carrier element to the cleaning device.

Various carrier elements (such as a toner feed element, an inking element, a developer element or a photoconductor element) can thus be cleaned of remaining toner with such a cleaning device.

The cleaning device advantageously comprises a plurality of electrodes spaced from one another that are controlled by a control unit in the sense of a traveling field generation. An electrical field is generated by the electrodes. Instead of the electrodes, magnetic field generation elements can naturally also be used via which a traveling magnetic field is then generated via which magnetic toner particles can be transported away.

The cleaning device with the electrodes is advantageously designed as a circuit board with conductor traces, whereby the conductor traces are designed as a plurality of electrodes arranged parallel to one another. If a flexible circuit board (conductor traces on a flexible, electrically insulating intermediate layer) is used, the circuit board can be attached on a shaped, largely rigid carrier element. The toner can then be better directed in the direction of a toner mixture container and be directed back again into the printing system.

It is also advantageous to control a plurality of groups of electrodes with an alternating voltage. The voltage can thereby change cyclically in a sinusoidal, stepped or also linear manner from a small amplitude to a large amplitude and vice versa. It can thereby be achieved in a simple manner that traveling fields are generated in corresponding desired directions in that the various groups of electrodes are activated correspondingly. It is also possible to simultaneously generate different directions of traveling fields in that other groups of electrodes are activated in a different direction.

A section from an electrographic printing or copying device is shown in a section image in FIG. 1. In the present exemplary embodiment only the developer station 10 is shown via which toner is fed to a photoconductor belt of an electrographic printing system. The exposure station and the fixing station are not shown, nor are the printing substrate feed and post-processing.

Given the electrophotographic printing principle electrically-charged toner particles 11 (also designated as toner in the following) are mixed with magnetic or ferromagnetic carrier particles 12 and form what is known as a two-component mixture (also designated as a toner mixture 13). This mixture 13 is supplied to a bucket roller 16 via a merging screw 15. Toner consumed by the printing is replenished by the toner transport coil 14. The bucket roller 16 rotates and thereby triboelectrically charges the toner 11. The bucket roller 16 comprises buckets (not shown) arranged distributed over its length, which buckets convey toner mixture from the bucket roller 16. Due to a helical design a portion of the mixture 14 is transported along the entire length of the bucket roller 16 so that toner mixture can be conveyed away by the buckets all along the bucket roller 16. At the end the remaining mixture 13 is conveyed to the front again by the merging screw 15 or transport screw and resupplied to the bucket roller 16.

The toner mixture 13 is supplied to an inking roller 18 over the entire length via the bucket roller 16. This inking roller 18 comprises a rotating hollow roller 19 with a magnetic roller stator 20 located inside it.

The magnetic roller stator 20 comprises permanent magnets or electromagnets 21 that are arranged stationary along the inner circumference of the hollow roller 19. The magnets 21 attract the carrier particles 12 (and therewith the toner particles 11 adhering to the carrier particles 12) towards the surface of the hollow roller 19. Due to the rapidly rotating hollow roller 19 the toner mixture 13 (which adheres slightly to the surface) is transported into proximity of an applicator roller (designated as a jump roller 25 in the following).

Given the electrophotographic principle, an electrical field that is generated via application of distinctly different electrical potentials (for example −1000 V or −300 V) exists between the inking roller 18 and the jump roller 25. The electrically-charged toner particles 11 are drawn towards the jump roller 25 by the electrical field when the toner is located near enough to the jump roller 25 and the field forces on the toner are greater than the adhesion forces on the carrier particles 12 as well as the hollow roller 19 and the magnetic forces. The region of the transition or of the application of toner onto the jump roller 25 is designated here as an accumulation point 26 since the toner is accumulated in a laminar manner (optimally without gaps) on the jump roller 25.

The carrier particles 12 are magnetically or ferromagnetically designed (for example, they are produced from iron). They are not electrostatically charged and are therefore not drawn to the jump roller 25 (only in an undesirable manner when the toner 11 adheres too strongly to the carrier particles 12 and the electrical field is strong enough), but rather react to magnetic fields due to their magnetic properties. The carrier particles 12 are transported further along the surface of the hollow roller 19 due to the fast rotation of the hollow roller 19 and the attraction force of the magnets 21. Due to the centrifugal force and gravity, the carrier particles 12 drop off from the surface of the inking roller 18 after the accumulation point 26 and fall downwards (due to gravity) into a reservoir for toner 11 and carrier particles 12. The carrier particles 12 can thus be fed again to the bucket roller 16 and therewith to the printing process.

The goal of the accumulation of toner 11 at the jump roller 25 is that the jump roller 25 is coated with a thick layer of toner particles 11 without gaps on its surface between the accumulation point 26 and a subsequent transfer point 27.

For instance, still-present carrier particles 12 that have likewise attached to the jump roller 25 in an undesirable manner are removed by a carrier capture roller 30. This carrier capture roller 30 is likewise provided as a magnetic roller with a rotating hollow roller 31 and a stationary magnetic roller stator 32. Only toner particles 11 thus arrive at the transfer point 27 where toner 11 is transferred onto a photoconductor at those points at which a print character should also be.

The photoconductor here is designed as a photoconductor belt 34. This photoconductor belt 34 is initially electrostatic charged (for example to −550 V) and discharged at points (for example −30 V) via an optical unit corresponding to the points/characters to be printed or not to be printed. Toner 11 is drawn to the photoconductor belt 34 only at these points via a correspondingly directed electrical field between the jump roller 25 and the discharged points of the photoconductor belt 34. The toner 11 is then fed to a transfer printing station (not shown) in the further course of the photoconductor belt 34. The toner is then transferred onto a printing substrate, recording medium or final image medium (for example paper or plastic film) and subsequently fixed.

Since only a small portion of the toner particles 11 normally jump over onto the photoconductor belt 34 (dependent on the respective print image), many toner particles 11 remain adhered to the jump roller 25. In order to again obtain a uniformly thick toner particle carpet after the accumulation point 26 of the inking roller 18, the remaining toner particles 11 should initially be removed from the jump roller 25. This occurs via a cleaning device 35.

The cleaning device 35 exhibits on its surface distinctly different voltage potentials relative to the surface of the jump roller 25. An electrical field (see arrow 33 in FIG. 2) thereby arises between the jump roller 25 and the cleaning device 35, via which toner particles 11 jump over from the jump roller 25 onto the cleaning device 35 when the toner particles 11 arrive close enough to the cleaning device 35. The typical smallest distance between jump roller 25 and cleaning device 35 is approximately 0.2 to 0.3 mm so that (given the existing voltage potentials) toner particles 11 can jump this distance as a consequence of the electrical field and thus are attracted.

The cleaning device 35 additionally comprises a traveling field generation element via which an electrostatic and/or magnetic traveling field is generated that transports the toner particles 11 along the propagation direction (see arrow 36 in Figures) of the traveling field. The toner particles 11 can thus be transported in a targeted manner to desired points corresponding to the direction of the traveling field. It is advantageous when the electrical field for attracting the toner particles 11 is generated as well by the traveling field.

In the exemplary embodiment according to FIG. 1 the toner particles 11 are transported in the direction of the carrier particles 12 falling from the inking roller 18 and mix with these. The mixture then sinks in the direction of the bucket roller 16 and is thus fed again to the printing process.

Figure 2:
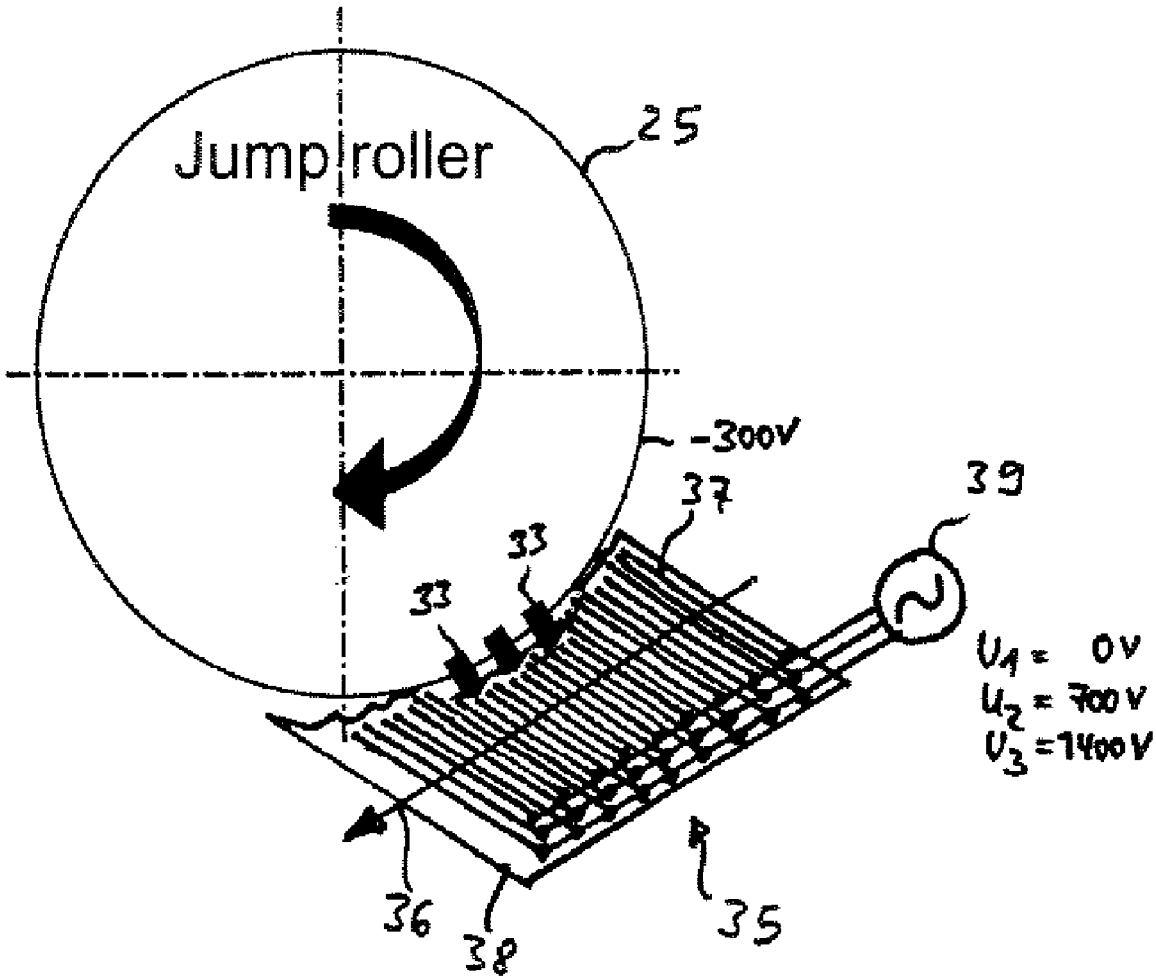
FIG. 2 shows a cleaning device of the printing or copying device according to FIG. 1.

According to FIG. 2 an exemplary embodiment of a traveling field generation element of a cleaning device 35 comprises a plurality of electrodes 37 arranged approximately parallel to one another, which electrodes 37 are designed as conductor traces on a circuit board 38. The individual conductor traces or electrodes 37 are provided (via an alternating voltage source 39) with different voltage potentials (here the three voltage potentials $U_1$, $U_2$ and $U_3$). If the electrodes 37 are provided with the voltage potentials consecutively and in cyclical rotation (i.e. are consecutively and alternately activated in a phase-shifted manner in one direction), a traveling field arises transverse to the electrodes 37 (traveling field direction 36 in FIG. 2).

According to FIG. 2, a plurality of groups of electrodes 37 are provided (each group there comprises three electrodes 37), whereby within a group the various electrodes 37 are supplied with different voltages that are varied cyclically such that an electrical field (traveling field) progressing transverse to the electrodes 37 arises.

When the jump roller 25 exhibits on its surface a voltage potential of, for example, approximately −300 V and the voltage potentials of the electrodes 37 are distinctly deviating from this (distinctly more positive in the exemplary embodiments), a negatively-charged toner particle 11 is thus attracted from the jump roller 25 to the electrodes 37. Since the electrical field is inversely proportional to the distance between the respective parts, the cleaning device 35 must approach the jump roller 25 up to approximately 0.2 to 0.3 mm when the voltage potentials of the cleaning examination volume 35 are greater than/equal to 0 V and the jump roller 25 exhibits a potential of −300 V.

When the voltage potentials of the various electrodes 37 are all greater than, for example, 0 V, the electrodes 37 also already act in an attractive manner on the negatively-charged toner particles 11. To generate the traveling field, groups with three electrodes 37 can be present, whereby a voltage potential of $U_1$=0 V can be present at the first electrode, a voltage potential of $U_2$=+700 V can be present at the second electrode and a voltage potential of $U_3$=+1400 V can be present at the third electrode. This is equivalent to a step-like alternating voltage with the three voltage values $U_1$, $U_2$ and $U_3$ that are applied phase-shifted to the electrodes 37.

No separate field generation device is then necessary in order to draw the toner particles 11 from the jump roller 25 to the cleaning device 35; rather, the different voltage potentials of the electrodes 37, all of which are distinctly higher than the voltage potential of the jump roller 25, are sufficient here.

The toner particles 11 attracted by the electrodes 37 are then transported forward along the direction of the traveling field by the traveling field of the electrodes 37. Since the movement of the toner particles 11 is generated by electrical fields, barely any mechanical load is exerted on the toner particles 11. The toner particles 11 can therefore be used without further measures for the further printing process and be resupplied to the toner mixture 13, from where they arrive on the surface of the jump roller 25 via the bucket roller 16 and the inking roller 18.

Figure 3:
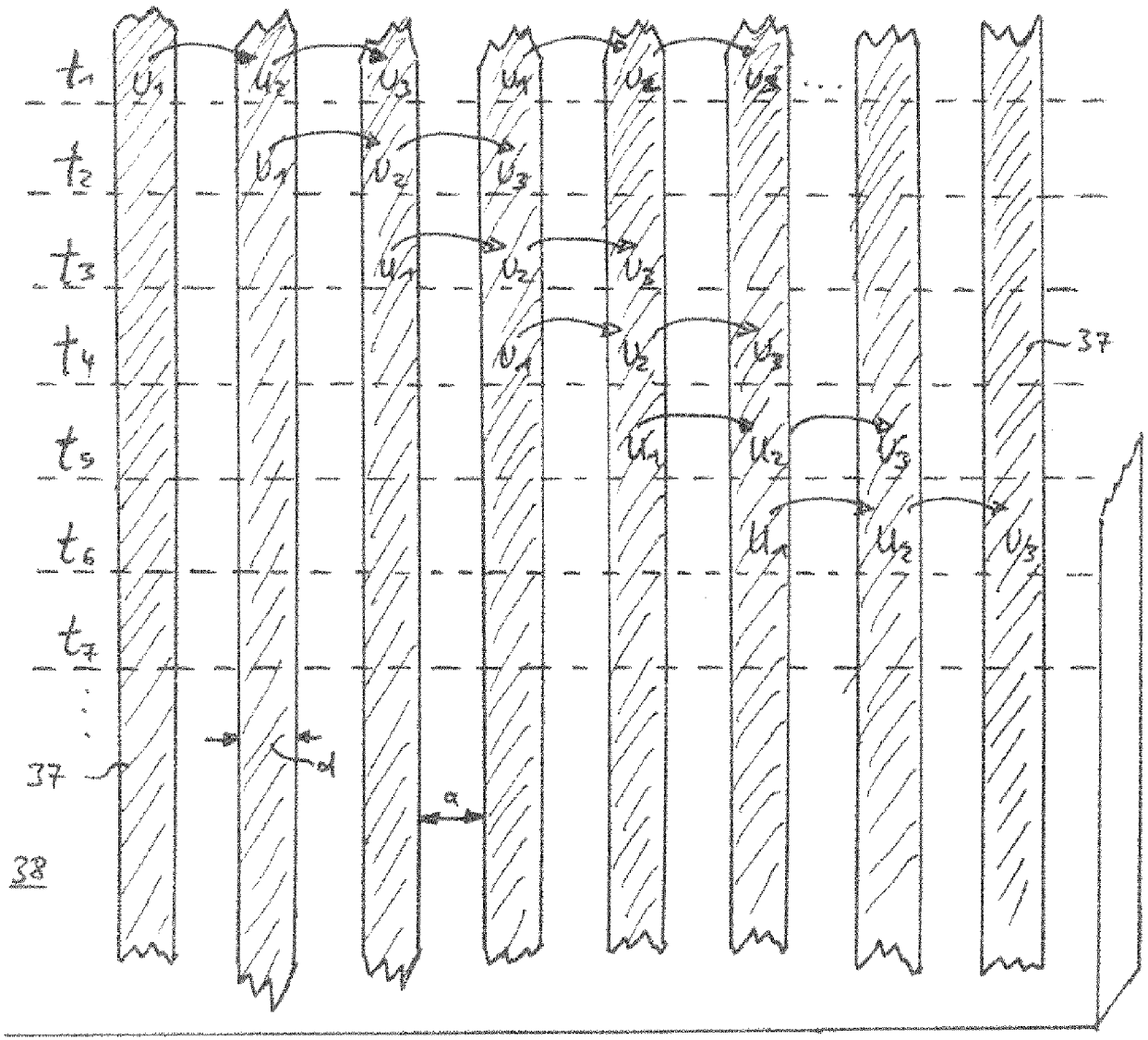
FIG. 3 shows a traveling field generation element of the cleaning device according to FIG. 2.

An exemplary embodiment for a circuit board 38 of the cleaning device 35 is shown in FIG. 3. A plurality of electrodes 37 are thereby arranged parallel to one another. The distance a from electrode to electrode is, for example, a=0.2 mm and the width d of an electrode is likewise d=0.2 mm, The thickness of the electrodes 37 can be a typical thickness of conductor traces on a circuit board 38, for example from 20 to 400 μn.

Due to the small distances a and the very slight thickness, it is possible that the toner particles 11 are drawn from one electrode to another (as a consequence of an electrical field between the electrodes 37) without remaining attached to the electrodes 37.

When (as schematically indicated in FIG. 3) the voltage potentials $U_1$ to $U_3$ are now switched along from one electrode to the adjustment electrode from time to time (crossover switching points in time $t_1$ through $t_7$ are plotted to the left in FIG. 3), a voltage difference thus always arises between two adjacent electrodes 37 that changes continuously and cyclically transverse to the electrodes 37 and advances in the traveling field direction 36. A traveling electrical field is thereby created via which negatively-charged toner particles 11 are drawn along and are consequently moved and transported in the direction of the traveling field.

As in the example according to FIG. 2, the voltage potentials of the electrodes 37 can thereby be cyclically changed in stages from $U_1$=0 V to $U_2$=+700 V and further to $U_1$=+1400 V as well as then back to $U_1$=0 V. Finer stepped sub-divisions for the voltage potentials can also be effected, which then also leads to a higher number of electrodes 37 within a group. It is thereby essential that the potential differences between two electrodes 37 is great enough in order to draw the toner particles 11 from electrode to electrode in order to thereby create a traveling field via which the toner particles 11 are transported forward along the circuit board 37.

Instead of staged or stepped changes of the voltage potentials, a sinusoidal or continuous linear change of the voltage potentials can also be cyclically effected.

Figure 4:
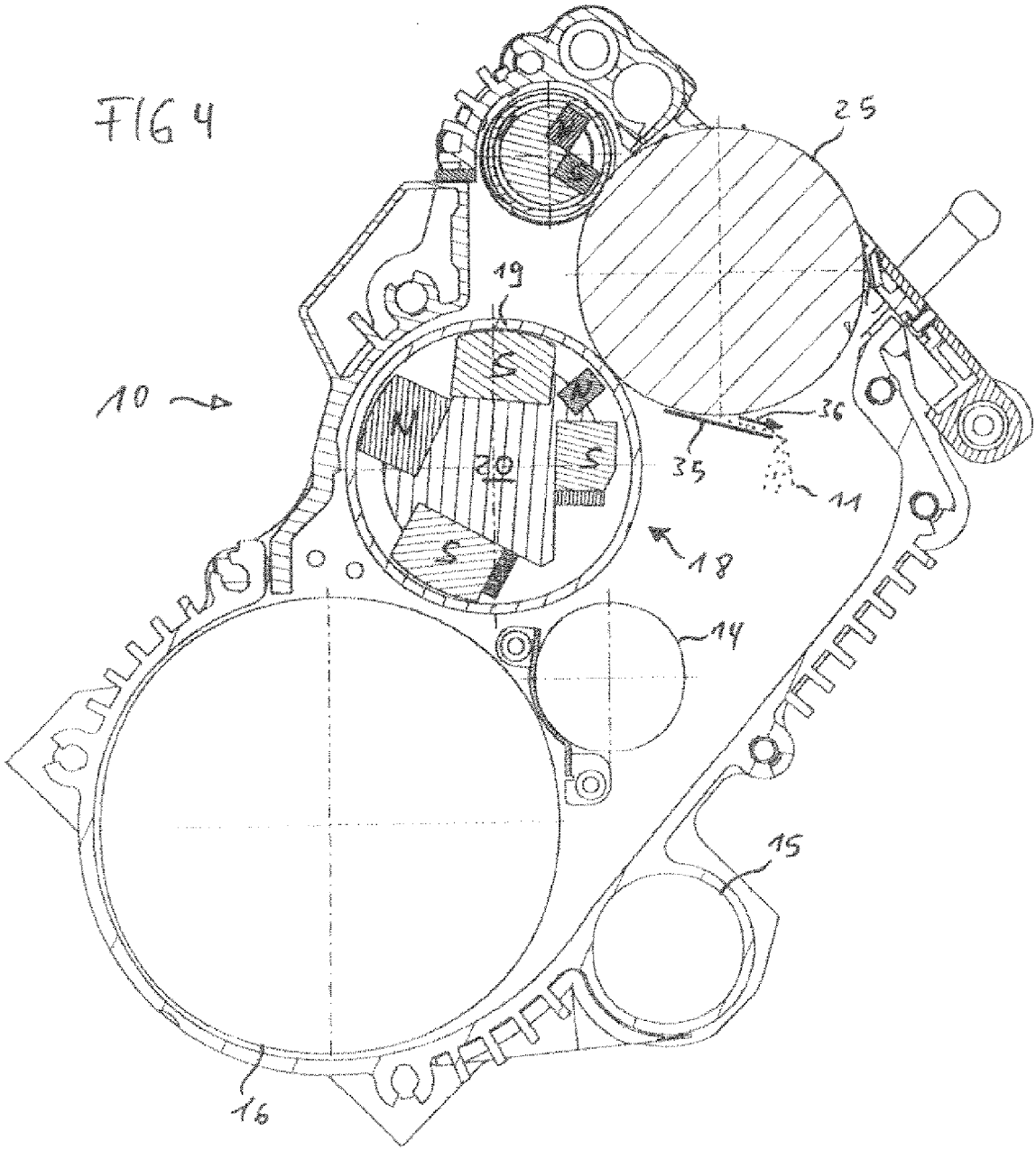
FIGS. 4 through 6 are further exemplary embodiments of the cleaning device in a respective electrographic printing or copying device (respectively shown in parts and in a section image).

The direction of the traveling field thereby depends on the activation of the field generation elements (here the electrodes 37) by the alternating voltage source 39. The circuit board 38 is located at one end in proximity to the jump roller 25 and leads approximately tangentially away from the jump roller 25 in the direction of the bucket roller 16 in which the toner mixture 13 is prepared (see FIG. 1). The circuit board 38 can also be arranged with the other end in proximity to the jump roller 25 and leads approximately tangentially away, however in the opposite direction as before (see FIG. 4). The respective traveling field is then designed proceeding (in Figures) either from right to left (FIG. 1) or from left to right (FIG. 4) corresponding to the activation of the electrodes 37.

Figure 5:
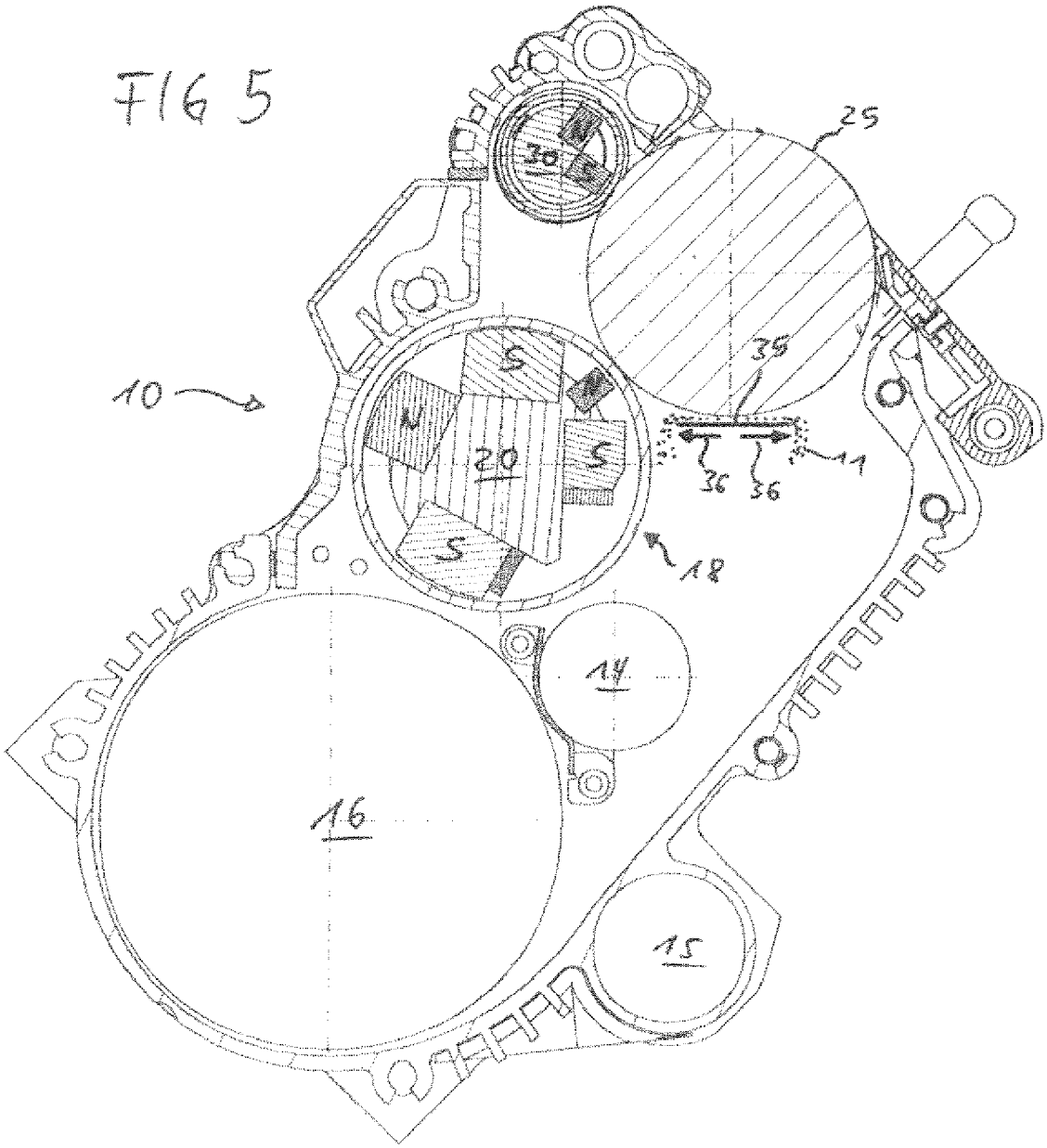

It is likewise possible in a simple manner to generate two or more traveling fields via which (as shown in FIG. 5) traveling fields arise in different proceeding directions. For example, the toner can thus be transported away to both sides of the cleaning device 35. When the toner is moved in the direction of the inking roller 18 and therewith in the direction of the carrier particles 12 transported away from the inking roller 81 the toner particles 11 can already admix with the carrier particles 12 and again be supplied mixed to the entire process via the bucket roller 16 and the inking roller 18.

It is advantageous when the beginning of the toner transport (at the electrode where the toner particles 11 are drawn from the jump roller 25 to the cleaning device 35) by the traveling field lies in the region of the nearest approach of the cleaning device 35 to the jump roller 25. It is thereby ensured that the toner cannot arrive back on the jump roller 25 and is transported away from the jump roller 25 by the traveling field.

The circuit board 38 does not necessarily have to be designed flat. It can also be curved convexly or concavely or be spatially shaped otherwise. At the point that comes nearest to the jump roller surface, the toner particles are drawn to the circuit board 38 and then transported away corresponding to the traveling field and its direction 36. At the end of the circuit board 38, the toner particles fall away from the circuit board 38 due to gravity. The falling away from the circuit board 38 could also be achieved via corresponding electrical fields that act in a repulsive manner on the toner particles 11.

Figure 6:
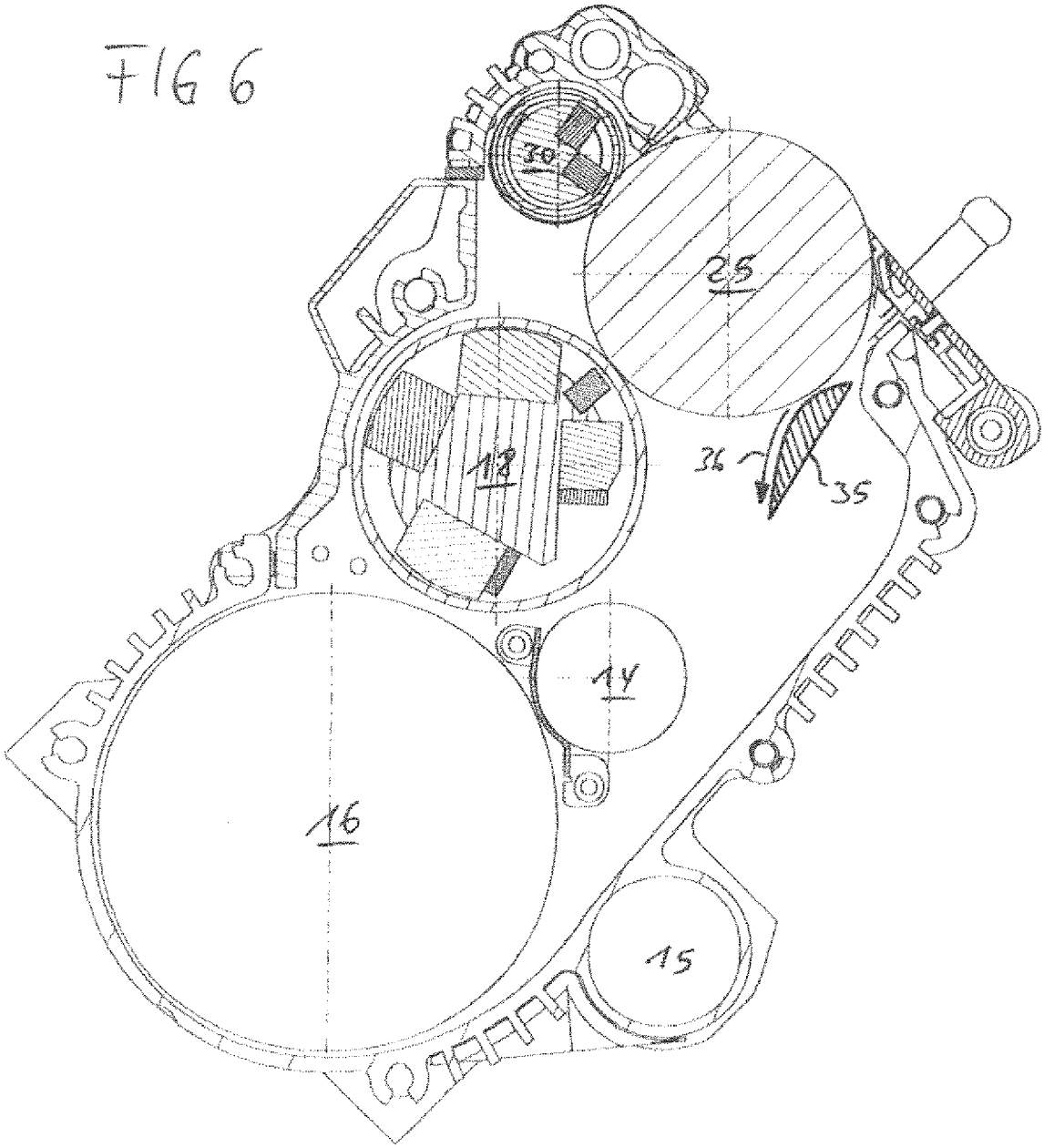

As shown in FIG. 6, the circuit board 38 can also be designed as a three-dimensional circuit board 38. For this a flexible circuit board 38 can be attached on a shaped, rigid carrier 40. In this exemplary embodiment the cross-section of the carrier 40 is arced with a small space at one end from which the toner is transported away in the direction of the other end due to the traveling field. The electrodes 37 thereby run approximately parallel to one another and extend in the axial direction of the jump roller 25 over the entire length of the jump roller 25. It is thereby ensured that the toner is removed from the jump roller 25 over the entire length. The shape of the carrier 40 is thereby designed such that the toner 11 moving along the traveling field is transported away from the jump roller 25.

The outer surface of the first carrier element (jump roller 25) exhibits a roughness in the range from 1 to 5000 μm. The toner particles 11 thereby remain well attached in order to transport them from the accumulation point 26 to the transfer point 27. On the other hand, the surface is then not too rough to remove the toner particles 11 remaining on the surface from this by the cleaning device 35.

The surface of the second carrier element (this is the photoconductor belt 34 in the described exemplary embodiments) comprises at least the components aluminum, chromium, nickel, copper, conductive plastic and/or plastic with a conductive layer. The toner can thereby accumulate well there.

As in the previous exemplary embodiments, the cleaning device 35 with electrodes 37 can be designed such that a traveling electrical field is created. The traveling electrical field is then used when electrostatically-charged toner 11 is to be transported away. Magnetic or ferromagnetic toner can be transported away via a magnetic field. For this the cleaning device must exhibit magnetic field generation elements that are activated such that a traveling magnetic field is created. The cleaning device can likewise be designed as an electromagnetic traveling field generation element in order to transport both electrically-charged particles and magnetic or ferromagnetic particles away.

In the method for operation of an electrographic printing or copying device, to clean a first carrier element the toner particles 11 are removed from the first carrier element by a field-generating device in that a first field is generated. According to the preferred embodiment, an electrical, magnetic or electromagnetic field in the manner of a traveling field is generated to transport the toner away, in that a field-generating unit of the cleaning device 35 is cyclically activated. The toner particles 11 are transported along by this traveling field.

It is advantageous when the traveling field is simultaneously used as well to transfer the toner from the first carrier element onto the cleaning device 35. Given the electrostatically-charged toner 11, this can occur due to the voltage potentials $U_1$, $U_2$, $U_3$ of the participating elements. For this the first carrier element exhibits a distinctly different voltage potential relative to all voltage potentials of the field-generating unit with its electrodes 37. Additional necessary parts are thereby spared.

Due to the transport of the toner away via the traveling field, no mechanically moving parts are necessary. No element of the cleaning device 35 contacts the first carrier element. Also, no spatula that abrades the toner from the first carrier element is therefore necessary.

The toner particles 11 are thereby transported virtually without contact, and in fact only by means of electrical, magnetic or electromagnetic fields, which leads to a significantly lower mechanical stressing of the toner particles 11. The mutual abrasion of the particles on one another is likewise less.

Different directions 36 of traveling fields or also a plurality of traveling fields with different directions can then be generated via simple activation of the field-generating unit (alternating voltage source 39). The carrier elements to be cleaned can be inking elements, toner feed elements, developer elements, photoconductor elements or other toner-transporting elements that are designed as cylindrical rollers or in the form of endless belts. The toner 11 or also the toner mixture 13 can be transferred from the carrier element to further carrier elements (such as, for example, photoconductor elements) or to recording media to be printed. That element from which the toner 11 or the toner mixture 13 is transferred to another carrier element must subsequently be cleaned so that new toner 11 or toner mixture 13 can therewith be cleanly applied. This increases the quality of the generated print image.

The preferred embodiment depends not on whether the printing or copying devices operate according to the electrophotographic, electromagnetic or other printing principles, but rather on toner particles 11 being cleanly removed from a carrier element fur the purposes of cleaning and being supplied to a reservoir. The cleaning device 35 thereby provides the corresponding field in order to attract and then to also transport away the electrically-charged or magnetic toner particles 11. The electrophotographic principle, given which the toner is electrostatically charged and transported by means of electrical fields, is advantageously used. The cleaning device 35 then comprises electrodes 37 for generation of a traveling electrical field.

While a preferred embodiment has been illustrated and described in detail in the drawings and foregoing description, the same is to be considered as illustrative and not restrictive in character, it being understood that only the preferred embodiment has been shown and described and that all changes and modifications that come within the spirit of the invention both now or in the future are desired to be protected.

I claim as my invention:

1. An electrographic printing or copying device, comprising:

a first carrier element on whose surface toner particles are accumulated in a region of an accumulation point and from whose surface at least a portion of the toner particles in a region of a transfer point are transferred onto a further carrier element;

a cleaning device arranged in a region between the transfer point and the accumulation point and at a distance from the first carrier element in order to remove the toner particles still remaining on the first carrier element after transfer of the toner particles onto the further carrier element;

one part of the cleaning device is arranged near the first carrier element and the other part of the cleaning device is spatially designed such that it leads away from the first carrier element such that the removed toner particles are transported away from the first carrier element by the cleaning device;

a field between the cleaning device and the first carrier element which attracts the toner particles to be removed from said first carrier element; and the cleaning device comprising a field-generating unit via which said field is generated as a traveling field via which the attracted toner particles are transported away along a progression direction of the traveling field.

2. A device of claim 1 wherein the field comprises an electrical field.

3. A device of claim 1 wherein the field comprises a magnetic field.

4. A device according to claim 1 wherein the first carrier element comprises a toner feed element, an inking element, a developer element or a photoconductor element in the form of a cylindrical roller or an endless belt via which toner is transferred from the carrier element onto the further carrier element.

5. A device according to claim 1 wherein the further carrier element comprises a photoconductor element or a final image medium to be printed.

6. A device according to claim 1 wherein the cleaning device comprises a plurality of electrodes spaced from one another that are activated by a control unit for traveling field generation.

7. A device according to claim 6 wherein the electrodes are designed as conductor tracks and are mounted on a flexible, electrically-insulating intermediate carrier layer that is affixed on a spatially shaped, substantially rigid carrier.

8. A device according to claim 1 wherein a magnetic unit is arranged in proximity to the first carrier element, magnetic carrier particles of the toner mixture being removed from the first carrier element by magnetic attraction forces.

9. A device according to claim 1 wherein an outer surface of the first carrier element has a roughness in a range from 1 to 5000 μm.

10. A device according to claim 1 wherein a surface of the second carrier element comprises aluminum, chromium, nickel, copper, conductive plastic and/or a plastic with a conductive layer.

11. A device according to claim 1 wherein the cleaning device comprises a magnetic and/or electrical field generation element, whereby a magnetic or an electrical traveling field is generated that acts with an attractive force on magnetic or electrically-charged toner particles.

12. A method for operation of an electrographic printing or copying device, comprising the steps of:

accumulating at least toner particles on a surface of a first carrier element;

after transfer of toner particles onto a further carrier element removing toner particles still remaining on the first carrier element by generating a field between the first carrier element and the cleaning device; and generating said field as a traveling field on a surface of the cleaning device via activation of a field generating unit of the cleaning device, said activation transporting the toner particles along by the traveling field.

13. A method according to claim 12 wherein the field generating unit comprises electrodes activated in groups by the control unit such that an electrostatic traveling field travels in a direction corresponding to the activation of the electrodes.

14. A method according to claim 13 wherein a voltage with cyclically changing amplitude is applied to a plurality of successively-arranged groups of electrodes within each group, whereby an alternating electrical field arises between the electrodes in a region of each group.

15. A method according to claim 14 wherein the voltage is cyclically changed in a sinusoidal, stepped or linear manner from a small amplitude to a large amplitude and vice versa.

16. A method of claim 12 wherein the field comprises an electrical field.

17. A method according to claim 12 wherein the field comprises a magnetic field.

18. An electrographic printing or copying device, comprising:

a first carrier element on whose surface toner particles are accumulated in a region of an accumulation point and from whose surface at least a portion of the toner particles in a region of a transfer point are transferred onto a further carrier element;

a cleaning device arranged in a region between the transfer point and the accumulation point from the first carrier element which removes the toner particles still remaining on the first carrier element after transfer of the toner particles onto the further carrier element;

a field between the cleaning device and the first carrier element which attracts the toner particles to be removed from said first carrier element; and said field comprising a traveling field via which the attracted toner particles are transported away along a progression direction of the traveling field.

19. A method for operation of an electrographic printing or copying device, comprising the steps of:

accumulating at least toner particles on a surface of a first carrier element; and after transfer of toner particles onto a further carrier element removing toner particles still remaining on the first carrier element by generating a traveling field between the first carrier element and the cleaning device which transports the toner particles.

* * * * *